US006299367B1

(12) United States Patent
Kawakami et al.

(10) Patent No.: US 6,299,367 B1
(45) **Date of Patent: *Oct. 9, 2001**

(54) COIL SPRING SHEET-PRESSING MEMBER FOR SHEET FEEDING MECHANISM

(75) Inventors: Hideki Kawakami; Kenichi Hirabayashi, both of Nagano (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/288,170

(22) Filed: Apr. 8, 1999

(30) Foreign Application Priority Data

Apr. 9, 1998 (JP) ..... 10-097761
May 6, 1998 (JP) ..... 10-123771

(51) Int. Cl.[7] ..... B41J 13/076

(52) U.S. Cl. ..... 400/634; 400/645; 400/645.4; 267/180; 267/272; 347/104

(58) Field of Search ..... 267/180, 182, 267/272, 156; 460/637.3, 637, 636.3, 636, 625, 645, 645.3, 645.4, 654.5, 634; 347/104; 271/273, 274

(56) References Cited

U.S. PATENT DOCUMENTS 274,715 * 3/1883 Buckley ..... 267/180
653,155 * 7/1900 Tilden ..... 267/182
1,462,925 * 7/1923 Wilburger ..... 267/179
1,963,053 * 6/1934 Powers ..... 267/272
2,852,801 * 9/1958 Doljan ..... 267/180
4,077,619 * 3/1978 Borlinghaus ..... 267/166
5,534,894 7/1996 Hirano et al. ..... 400/625
5,558,322 9/1996 Nakatomi ..... 271/209
5,868,383 * 2/1999 Codos ..... 267/80

FOREIGN PATENT DOCUMENTS 2 285 777 7/1995 (GB) .
2 290 262 A 12/1995 (GB) .
1-286872A 11/1989 (JP) .
2-41277 2/1990 (JP) .
6-255119A 9/1994 (JP) .
7-101588A 4/1995 (JP) .

OTHER PUBLICATIONS

Patent Abstracts of Japan, vol. 014, No. 203 (M–0966) Apr. 25, 1990 & JP 02 041277 A—Feb. 9, 1990 (Canon Inc.) abstract.

Patent Abstracts of Japan, vol. 096, No. 009 Sep. 30, 1996 & JP 08 133545 A May 28, 1996 (Ricoh Co. Ltd.) abstract.

* cited by examiner

*Primary Examiner*—Daniel J. Colilla
(74) *Attorney, Agent, or Firm*—Nixon & Vanderhye P.C.

(57) ABSTRACT

A sheet feeding mechanism includes a sheet feed roller for transporting a sheet along a paper transport path, and a sheet-pressing member disposed so as to press the sheet feed roller. The sheet-pressing member integrally includes a pressing portion which is formed by increasing the diameter of a part of a coiled portion of a compression coil spring.

19 Claims, 5 Drawing Sheets

COIL SPRING SHEET-PRESSING MEMBER FOR SHEET FEEDING MECHANISM

BACKGROUND OF THE INVENTION

The present invention relates to a sheet feeding mechanism in use with an ink jet printer, for example, and more particularly to a sheet feeding mechanism including an object pressing member for pressing a printed sheet.

To print by an ink jet printer, the nozzle orifices of a printhead selectively eject ink drops onto a printing paper in accordance with print information while synchronizing with a relative movement of a printhead relative to a printing paper.

Generally, to feed a printing paper in the printer, the printing paper is nipped by a pair of paper-feed rollers, and one of the paired rollers is rotated.

In the case of the ink jet printer, characters, for example, printed on the printing paper are not fixed. Accordingly, when the printed paper is pressed against the rollers, ink of the printed characters is still wet. The wet ink sticks onto the roller, and is transferred from the roller to the sheet or paper.

An ink jet printer designed to solve the ink sticking problem is disclosed in JP-A-2-41277.

In the ink jet printer, the sheet is held by pressing the medium on the sheet feed roller. Therefore, the ink jet printer indispensably includes a sheet-pressing member having a spur gear with sharp teeth on the shaft.

The sheet-pressing member is designed to act elastically to the spur gear or the shaft, and the thus designed member presses the printing paper against the sheet feed roller.

A contact area where the spur gear is in contact with the paper is small in the ink jet printer using the thus constructed sheet-pressing member. Therefore, no ink transfer to the paper takes place in such a printer.

The sheet-pressing member of the printer takes the form of a bar or a plate, and the thus shaped member, while being bent, presses the sheet against the sheet feed roller.

The sheet-pressing member has a large spring constant, and inevitably suffers from dimensional variations. For this reason, work to properly set a pressing force is very difficult.

Where the pressing force is too large, an excessive load acts on the paper being fed. On the other hand, where it is too small, a sheet feeding force is insufficient. Either case leads to degradation of print quality.

SUMMARY OF THE INVENTION

Accordingly, an object of the present invention is to provide an ink jet printer with a sheet feeding mechanism which imparts an optimum pressing force onto a sheet being transported.

To achieve the above object, there is provided an object pressing member for pressing a sheet being transported along a transport path, the object-pressing member including a pressing portion of large diameter being shaped like an eddy current by spirally coiling an elastic wire.

A sheet feeding mechanism includes a sheet feed roller and a sheet-pressing member disposed so as to press the sheet feed roller, the sheet-pressing member including a pressing portion of large diameter being shaped like an eddy current by spirally coiling an elastic wire.

A printer for printing on a sheet set therein, the printer having a printhead, and a sheet feeding mechanism disposed downward of the printhead when viewed in a sheet feeding direction, wherein the sheet feeding mechanism comprises a sheet feed roller for feeding a sheet printed by the printhead in a predetermined direction; and a sheet-pressing member disposed so as to press the sheet feed roller, the sheet-pressing member including a pressing portion of large diameter being shaped like an eddy current by spirally coiling an elastic wire.

The sheet-pressing member includes a coil spring portion formed by spirally coiling the wire so that the wire rings formed are brought into close contact with one another, and the pressing portion is formed by increasing the diameter of a part of the coil spring portion.

In this case, the pressing portion may be formed by increasing the diameter of the middle of a main body of the coil spring portion.

The pressing portion may be formed by increasing the diameter of both ends of a main body of the compression coil spring.

The sheet-pressing member 23 is constructed such that the eddy-current shaped pressing portion (e.g., a flat spiral spring) 23*a* of large diameter flexibly presses the slip sheet S against the sheet feed roller. With this feature, in design, a spring constant of it measured in the pressing direction may be set to be small when comparing with the conventional one.

This fact implies that even if dimensional variation of the manufactured sheet-pressing members 23 is relatively large, a variation of pressing forces of the sheet-pressing members, which impart onto the slip sheet S, is reduced.

Thus, the sheet feeding mechanism, an appropriate pressing force may stably be imparted onto the slip sheet S by properly selecting such factors as the effective number of turns and the diameter of the coil portion of the sheet-pressing member, and a material of the sheet-pressing member.

The sheet-pressing member takes an integral form. The feature of the integral form contributes to reduction of the number of required component parts and size reduction, and further easy assembling.

Thus, the sheet feeding mechanism of the invention, which is simple in construction, can stably impart a pressing force of an optimum magnitude onto the sheet while being free from external factors such as assembling accuracy and medium or paper thickness.

The ink jet printer equipped with the thus constructed sheet feeding mechanism succeeds in solving the wet-ink transfer problem in which ink is transferred from the sheet feeding mechanism to a printing paper immediately after it is printed, viz., the paper bearing printed characters, for example, which are still wet since it is not fixed. Further, the printer is capable of stably feeding the printing paper and hence printing at high print quality.

Further, according to the present invention, the printer comprises a printhead for printing characters, for example, on a sheet moving relatively to the printhead by ejecting ink drops through ink discharging orifices; and sheet-pressing members having pressing portions, located near to the discharging orifices, for pressing on the sheet at their positions not in contact with the ink of the characters immediately after printed, the positions being spaced apart from the ink discharging orifices, the sheet-pressing members each including a coil spring portion formed by spirally coiling an elastic wire so that the wire rings formed when coiled are brought into close contact with one another, and each the pressing portion being formed by increasing the diameter of a part of the coil spring portion.

With such a construction, the sheet, even if it is bent, does not come in contact with the nozzle face since it is separated by the sheet-pressing members. Therefore, no ink is transferred to the slip sheet S.

The pressing portions do not come in contact with the printed characters, for example, being still wet on the sheet. Therefore, the printer is free from ink sticking problem arising from the rubbing of the sheet with the sheet-pressing members.

The sheet-pressing members may include pressing portions for pressing down both sides of a region on the sheet immediately after characters, for example, are printed on the sheet.

In the construction, the sheet is pressed down at a plurality of positions by use of the pressing portions, and hence the sheet is reliably held down.

The thus constructed printer may include a wiper means for wiping ink stuck onto the ink discharging orifices while moving relatively to the ink discharging orifices, wherein the sheet-pressing members include pressing portions for pressing down the sheet while being located at positions out of a region including the ink discharging orifices when viewed in the wiping direction of the wiper means.

In the construction, the sheet-pressing members are located at positions out of a region including the ink discharging orifices when viewed in the wiping direction of the wiper means. Therefore, there is no chance that the pairs of the pressing portions of the sheet-pressing members come in contact with the wiper means, and hence that the wiper means is worn with those members. No degradation of the wiping ability of the wiper means results.

BRIEF DESCRIPTION OF THE DRAWINGS

FIG. 6 is a perspective view showing a key portion of a fourth embodiment of a sheet-pressing member according to the present invention.

DESCRIPTION OF THE PREFERRED EMBODIMENTS

The prefered embodiments of the present invention, which are believed to be preferred, will be described in detail with reference to the accompanying drawings.

Figure 1:
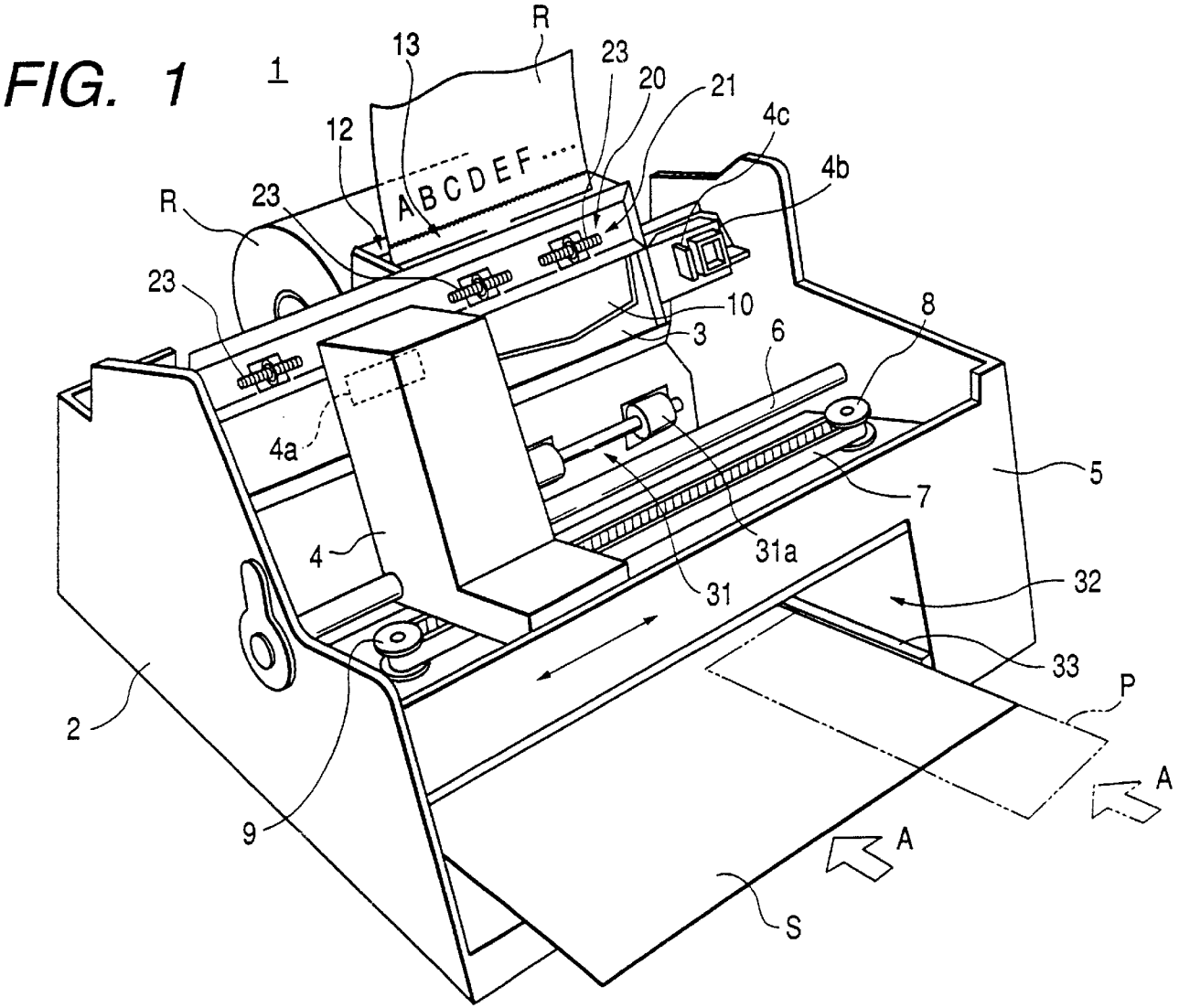
FIG. 1 is a perspective view showing an outline of an ink jet printer equipped with a sheet feeding mechanism that is a first embodiment of the present invention.

FIG. 1 is a perspective view showing an outline of an ink jet printer equipped with a sheet feeding mechanism that is a first embodiment of the present invention.

Figure 2:
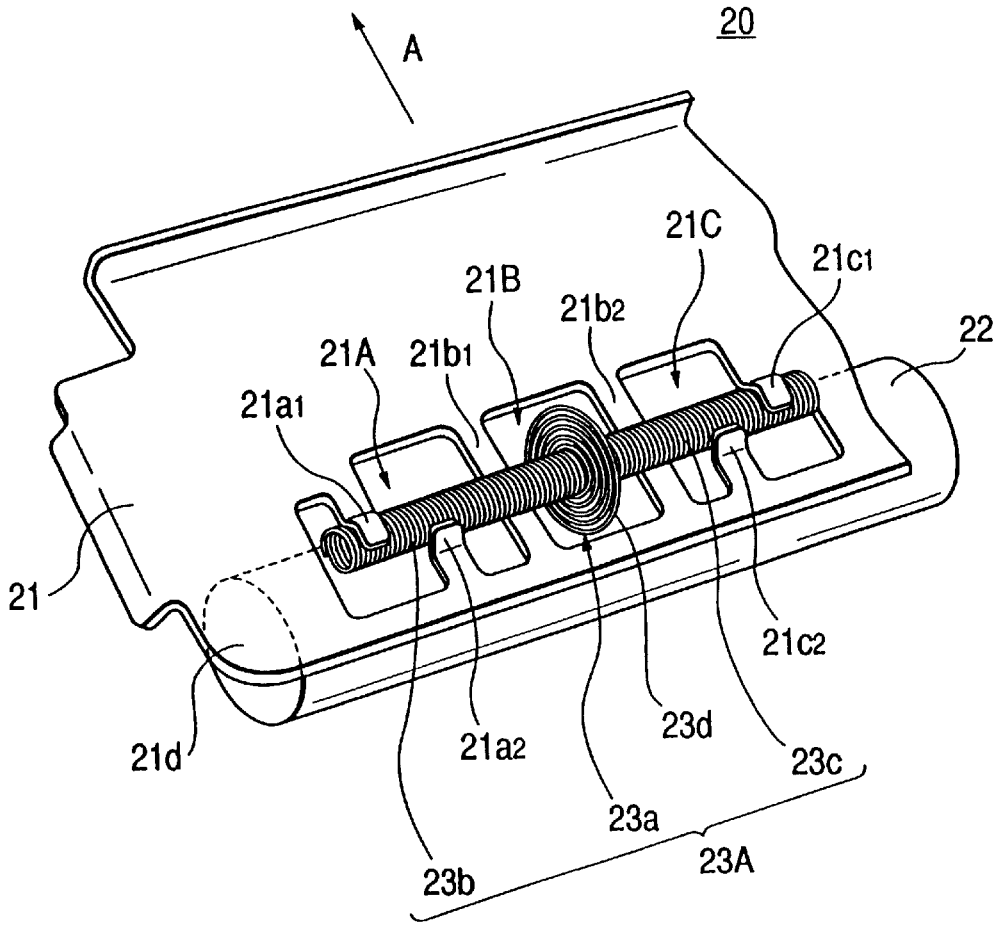
FIG. 2 is a perspective view showing a key portion of the sheet feeding mechanism of the first embodiment.
Figure 3:
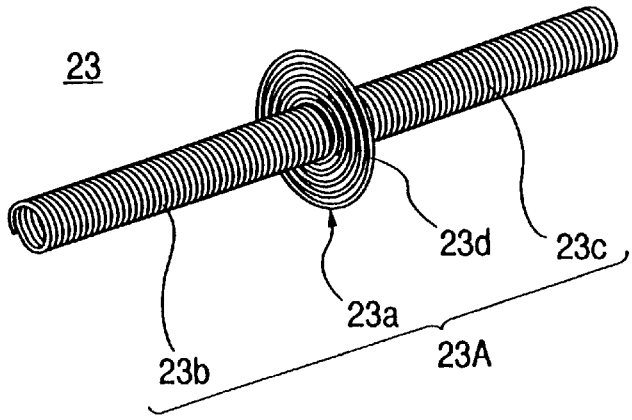
FIG. 3 is a perspective view showing a sheet-pressing member assembled into the sheet feeding mechanism of FIG. 2.

FIG. 2 is a perspective view showing a key portion of the sheet feeding mechanism of the first embodiment. FIG. 3 is a perspective view showing a sheet-pressing member assembled into the sheet feeding mechanism of FIG. 2.

As shown in FIG. 1, in a printer 1 constructed according to the invention, a printing unit 4 is disposed in a front portion within a main body case 2. The printing unit 4 prints on a slip sheet S or a check sheet P referred to as a slip sheet S. The case 2 is made of resin.

The printing unit 4 prints in a known ink jet printing manner. The printing unit 4 is movable along a guide shaft 6 within a limited range between both side ends of a main body frame 5 made of metal, for example. The guide shaft 6 is transversely mounted on the frame 5.

Pulleys 8 and 9 are rotatably supported at both sides of the frame 5. An endless belt 7 is wound on the pulleys 8 and 9.

The printing unit 4 is fastened to a part of the endless belt 7.

The printing unit 4 is disposed such that a printhead 4*a* of the printing unit is directed to the inside of the case 2.

A guide face 3 is disposed within the case 2 while confronting the printhead 4*a* of the printing unit 4. The guide face 3 is provided for guiding a slip sheet S.

A platen 10 is located on the inner side of the guide face 3. A slip sheet S is moved through a gap between the platen 10 and the printhead 4*a* of the printing unit 4. To print, the printhead 4*a* ejects ink drops onto the slip sheet S moving through the gap.

A cap 4*b* is provided adjacent to the platen 10. When the printer rests for a predetermined time period or longer, the printing unit 4 is moved to the position of the cap 4*b* to cover the nozzle orifices of the printhead 4*a* thereof with the cap 4*b*. With use of the cap 4*b*, the nozzles of the printhead 4*a* can be kept wet even when the printer is left not used for a long time.

A wiper (ink wiping means) 4*c* is further provided at a position near the cap 4*b*. The wiper 4*c* is provided for wiping ink off the nozzle-orifice array 42 of the printhead 4*a*. the wiper 4*c* is formed with an elastic plate-like member made of resin, for example.

A paper-insertion port 32 is formed in the front side of the main body of the printer 1. Slip sheets S are inserted through the paper-insertion port 32 into the printer inside. A rail-like guide member 33 is extended along one of side ends of the paper-insertion port 32. The rail-like guide member 33 guides a slip sheet S when it is inserted into the printer through the port 32.

Paper transporting means 31 is provided within the main body of the printer 1. The paper transporting means 31 transports a slip sheet S, which comes in through the paper-insertion port 32, toward the printing unit 4.

A construction of the paper transporting means 31 is: a couple of rotary shafts each having a plurality of rollers fixedly mounted thereon in a state that the rollers are spatially separated in the axial direction, are coupled such that the rollers of the shafts are aligned to form pairs of rollers each pair of rollers being in contact with each other. In FIG. 1, one roller shaft having a couple of rollers 31a mounted thereon is typically illustrated for simplicity of illustration. The roller shaft is oriented in a paper width direction, i.e., perpendicular to a sheet feeding direction A.

A plurality of sheet feeding mechanisms 20, which will be described in detail later, are disposed in the upper portion of the printer main body, specifically at positions adjacent to the platen 10 and located downstream when viewed in the sheet feeding direction A. A discharge outlet 13 is formed located downstream of the sheet feeding mechanism 20 when viewed in the sheet feeding direction A. A printed slip sheet S is discharged through the discharge outlet 13.

A roll paper R is located in the rear portion within the main body case 2 of the printer 1. A paper exit port 12 is provided in the upper portion within the case 2. The leading end of the roll paper R is led out of the paper exit port 12. The roll paper R passes through a paper transporting path, which is different from a transporting path of the slip sheet S, although when the printer prints on the roll paper R, the roll paper R passes through the gap between the printhead 4*a* of the printing unit 4 and the platen 10.

As shown in FIGS. 1 and 2, each sheet feeding mechanism 20 includes a sheet feed roller 22 and a sheet-pressing member 23. The sheet feed roller 22 is coupled with a paper-feeding drive motor (not shown). The sheet-pressing member 23 holds the slip sheet S being transported by pressing down it on the sheet feed roller 22. The sheet-pressing member 23 is supported with a guide member 21 for guiding a slip sheet S.

The guide member 21 consists of a metal plate-like member shaped, by pressing, for example, to have an introducing portion 21*d* and claw-like pieces 21al and 21a2. The introducing portion 21*d* is provided for introducing the slip sheet S. The claw-like pieces 21*a* are for supporting and holding the sheet-pressing member 23. The guide member 21, which is mounted on the frame 5, is disposed along the guide face 3 of the printer 1 and facing the sheet feed roller 22 with a predetermined space being present therebetween.

The introducing portion 21*d*, which occupies an upstream end portion (when viewed in the sheet feeding direction A) of the guide member 21, is slanted in a direction in which its distance from the printer guide face 3 increases.

Three holes 21A, 21B and 21C are formed in the guide member 21 while being arrayed in the paper width direction. Claw-like pieces 21*a*1 and 21*a*2, and 21*c*1 and 21*c*2 are extended from the peripheral edges of the holes 21A and 21C. The claw-like pieces 21*a*1 and 21*a*2, and 21*c*1 and 21*c*2 support the side and upper portions of the sheet-pressing member 23. Coupling supports 21*b*1 and 21*b*2 are formed at portions between the holes 21A and 21B and between the holes 21B and 21C, respectively.

The sheet-pressing member 23 includes a spring body, which consists of a spring by spirally coiling a wire of stainless steel, for example. The spring body 23A of the sheet-pressing member 23 includes a disc-like pressing portion 23*a* and cylindrical shaft portions 23*b* and 23*c* continuing to the ends of the pressing portion 23*a*. The pressing portion 23*a*, occupying the central portion of the spring body, is formed like an eddy current. The shaft portions 23*b* and 23*c* are each formed so that the wire rings formed are brought into close contact with one another by an initial tension. Those portions 23*a*, 23*b* and 23*c* are formed with a single wire in an integral form.

As shown in FIG. 3, the pressing portion 23*a* of the sheet-pressing member 23 is shaped like a disc when viewed from side. It takes the form of a body formed by coupling together two cones together such that the bottom surfaces of them are in contact with each other. The outside diameter (diameter) of the pressing portion 23*a* is larger than that of the cylindrical shaft portions 23*b* and 23*c*. A contact portion 23*d* as the outermost circumferential edge of the pressing portion 23*a* is formed with one or two wires so as to reduce a contact area where it contacts with the slip sheet S. In the embodiment, the diameter of the cylindrical shaft portion 23*b* is selected to be equal to that of the shaft portion 23*c*.

The sheet-pressing member 23 may be manufactured by a manufacturing method using an automatic coiling machine.

The manufacturing process is a coiling method in which a wire for a coil spring travels tracing a predetermined path while being fed by a feed roller, and during the travel of the wire, it is curved at a predetermined curvature and twisted at a predetermined torsion. The diameter of a coil is varied by changing a position of a coiling pin set in the width of the wire traveling path.

In the method for manufacturing the sheet-pressing member employed, a coiling pin (not shown) is fixed to a predetermined position. One shaft portion 23*b* is first formed. Then, pressing portion 23*a*, larger in diameter than the shaft portion 23*b*, is formed in a manner that the coiling pin is gradually moved apart from the axial center of the coil, and then moved toward the axial center of the coil. Subsequently, the coiling pin is fixed at a predetermined position (the same position as the position used for forming the shaft portion 23*b*), and the other shaft portion 23*c* is formed in a similar manner.

As shown in FIG. 2, one shaft portion 23*b* of the sheet-pressing member 23 is grasped with the claw-like pieces 21*a*1 and 21*a*2, and the coupling support 21*b*1, while the other shaft portion 23*c* is grasped with the claw-like pieces 21*c*1 and 21*c*2, and the coupling support 21*b*2 . The thus grasped sheet-pressing member 23, while being angularly immovable, is held with the guide member 21.

The cylindrical shaft portions 23*b* and 23*c* of the sheet-pressing member 23, which are thus held, are somewhat bent, by the coupling support 21*b*1, between the claw-like pieces 21*a*1 and 21*c*1, whereby the sheet-pressing member 23 is immovable in the paper width direction.

The contact portion 23*d* of the pressing portion 23*a* of the sheet-pressing member 23 is protruded through the hole 21B of the guide member 21 to be in contact with the sheet feed roller 22, so that the shaft portions 23*b* and 23*c* are somewhat bent.

The sheet feeding mechanism for an ink jet printer is thus constructed. In operation, after subjected to printing by the printhead 4*a* in the printer 1, a slip sheet S is transported by the paper transporting means 31; guided by the introducing portion 21*d* of the guide member 21; and inserted into the space between the sheet feed roller 22 and the pressing portion 23*a* of the sheet-pressing member 23.

The pressing portion 23*a* presses the slip sheet S against the sheet feed roller 22, and is transported to the discharge outlet 13 with rotation of the sheet feed roller 22.

As recalled, the contact portion 23*d* of the pressing portion 23*a* is designed so as to have a small contact area where it contacts with the slip sheet S. Because of this, little ink is transferred to the slip sheet S during the sheet feeding.

The sheet-pressing member 23 is constructed such that the eddy-current shaped pressing portion 23*a* of large diameter flexibly presses the slip sheet S against the sheet feed roller. With this feature, in design, a spring constant of it measured in the pressing direction may be set to be small when comparing with the conventional one.

This fact implies that even if dimensional variation of the manufactured sheet-pressing members 23, caused by their assembly accuracy difference and paper thickness difference, is relatively large, a variation of pressing forces of the sheet-pressing members, which impart onto the slip sheet S, is reduced.

Thus, the sheet-pressing member of the invention is capable of stably imparting an appropriate pressing force on the slip sheet S through a designer's proper selection of such factors as the effective number of turns and the diameter of the coil portion of the sheet-pressing member 23, and a material of the sheet-pressing member. In this respect, improved print quality results.

It is noted that the pressing portion 23*a*, and the cylindrical shaft portions 23*b* and 23*c* supporting the former, those portions being all used for the sheet-pressing by the sheet-pressing member 23, are integrally formed. This feature contributes to reduction of the number of required component parts and size reduction, and further easy assembling.

Further, a plurality of sheet-pressing members 23 are arrayed in the paper width direction. Therefore, the sheet feeding mechanism can stably feed slip sheets S of different width dimensions.

Figure 4:
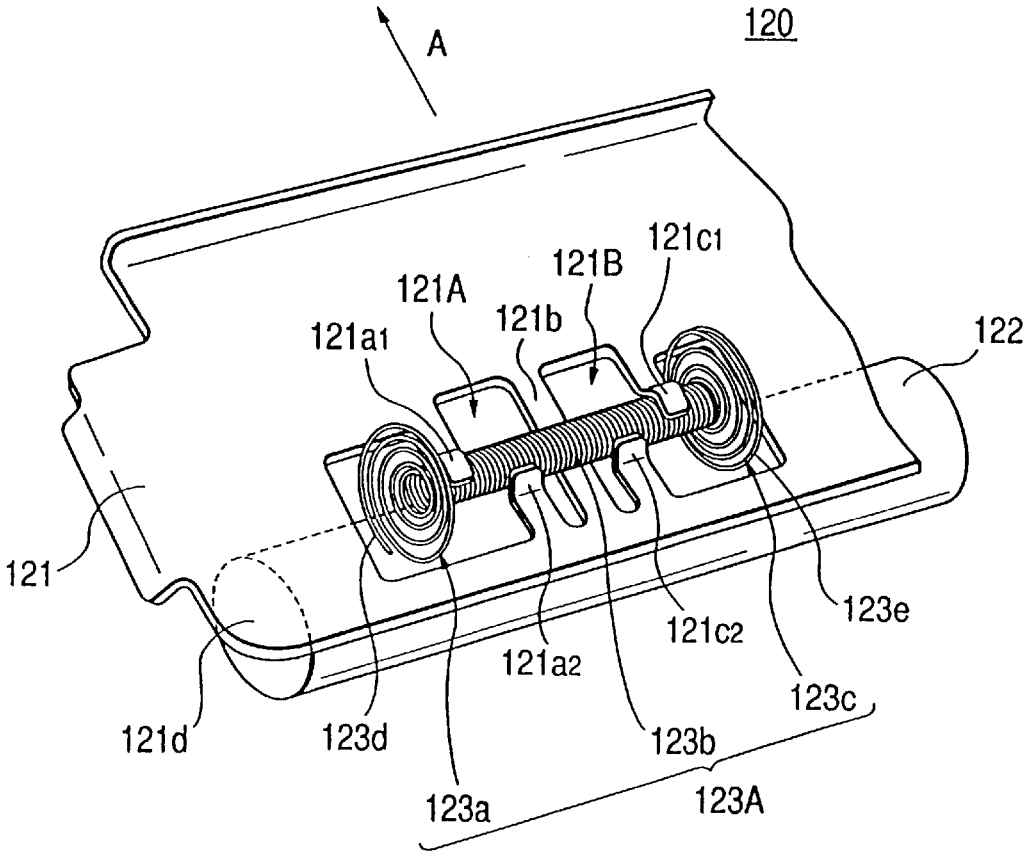
FIG. 4 is a perspective view showing a key portion of another sheet feeding mechanism that is a second embodiment of the invention.
Figure 5:
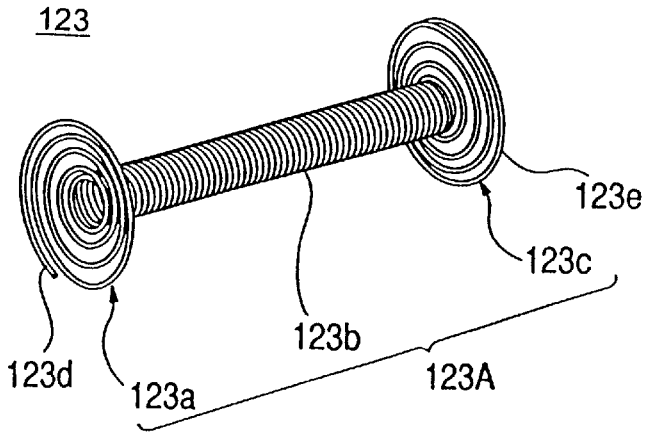
FIG. 5 is a perspective view showing another sheet-pressing member assembled into the sheet feeding mechanism constructed according to a third embodiment of the invention.

FIG. 4 is a perspective view showing a key portion of another sheet feeding mechanism that is a second embodiment of the present invention. FIG. 5 is a perspective view showing another sheet-pressing member assembled into the sheet feeding mechanism constructed according to the third embodiment of the invention.

As shown in FIG. 4, a sheet feeding mechanism 120, as in the first embodiment, includes a sheet feed roller 122 and a sheet-pressing member 123. The sheet-pressing member 123 presses the slip sheet S against the sheet feed roller 122. The sheet-pressing member 123 is supported with a guide member 121 including sheet introduction portion 121 for guiding a slip sheet S.

Two holes 121A and 121B are formed in the guide member 121 while being arrayed in the paper width direction. Claw-like pieces 121*a*1 and 121*a*2, and 121*c*1 and 121*c*2 are extended from the peripheral edges of the holes 121A and 121B. The claw-like pieces 121*a*1 and 121*a*2, and 121*c*1 and 121*c*2 support the side and upper portions of the sheet-pressing member 123. A coupling support 121*b* is formed at a portion between the holes 121A and 121B.

The sheet-pressing member 123, like the sheet-pressing member 23, includes a spring body 123A, which consists of a spring by spirally coiling a wire of stainless steel, for example.

As shown in FIG. 5, the sheet-pressing member 123 includes a cylindrical shaft portion 123*b* and pressing portions 123*a* and 123*c*, each shaped like a disc when viewed from side, formed at both ends of the cylindrical shaft portion 123*b*. The shaft portion 123*b* is formed so that the wire rings formed are brought into close contact with one another by an initial tension.

The pressing portions 123*a* and 123*c* are each formed like an eddy current. Those portions 123*a*, 123*b* and 123*c* are formed with a single wire in an integral form.

As shown in FIG. 5, the pressing portions 123*a* and 123*c* of the sheet-pressing member 123 are each shaped like a cone of which the apex connects to the end of the cylindrical shaft portion 123*b* and the bottom surface is directed outside. The outside diameter (diameter) of each of the pressing portions 123*a* and 123*c* is larger than that of the cylindrical shaft portion 123*b*.

Contact portion 123*d* and 123*e* as the outermost circumferential edges of the pressing portions 123*a* and 123*c* are each formed with one or two wires so as to reduce a contact area where each of them contacts with the slip sheet S. In the embodiment, the diameter of the pressing portion 123*b* is equal to the of the pressing portion 123*c*.

The sheet-pressing member 123 may also be manufactured by a manufacturing method using an automatic coiling machine as in the above-mentioned embodiment.

As shown in FIG. 4, the shaft portion 123*b* of the sheet-pressing member 123 is grasped with the claw-like pieces 121*a*1 and 121*a*2, and 121*c*1 and 12*c*2, and the coupling support 121*b*1 of the guide member 121. The thus grasped sheet-pressing member 123, while being angularly immovable, is held with the guide member 121.

The cylindrical shaft portion 123*b* of the sheet-pressing member 123, while being somewhat bent, are held between the claw-like pieces 121*a*1 and 121*c*1, whereby the sheet-pressing member 123 is immovable in the paper width direction.

The contact portions 123*d* and 123*e* of the pressing portions 123*a* and 123*bc* of the sheet-pressing member 123 are protruded through the holes 121A and 121B of the guide member 121 to be in contact with the sheet feed roller 122, so that the shaft portion 123*b* is somewhat bent.

The sheet-pressing member 123 of the second embodiment is also constructed such that the eddy-current shaped pressing portions 123*a* and 123*c* of large diameter flexibly press the slip sheet S against the sheet feed roller. With this feature, in design, a spring constant of them in the pressing direction may be set to be small when comparing with the conventional one. This fact implies that even if dimensional variation of the manufactured sheet-pressing members 123, caused by their assembly accuracy difference and paper thickness difference, is relatively large, a variation of pressing forces of the sheet-pressing members, which impart onto the slip sheet S, is reduced.

The pressing portions 123*a* and 123*c*, and the cylindrical shaft portion 23*b* supporting them, those portions being all used for the sheet-pressing by the sheet-pressing member 23, are integrally formed. This feature contributes to reduction of the number of required component parts and size reduction, and further easy assembling.

A fourth embodiment of the present invention will be described with reference to FIG. 6. The fourth embodiment is a printer incorporating thereinto a sheet-pressing member constructed according to the present invention.

Figure 6A:
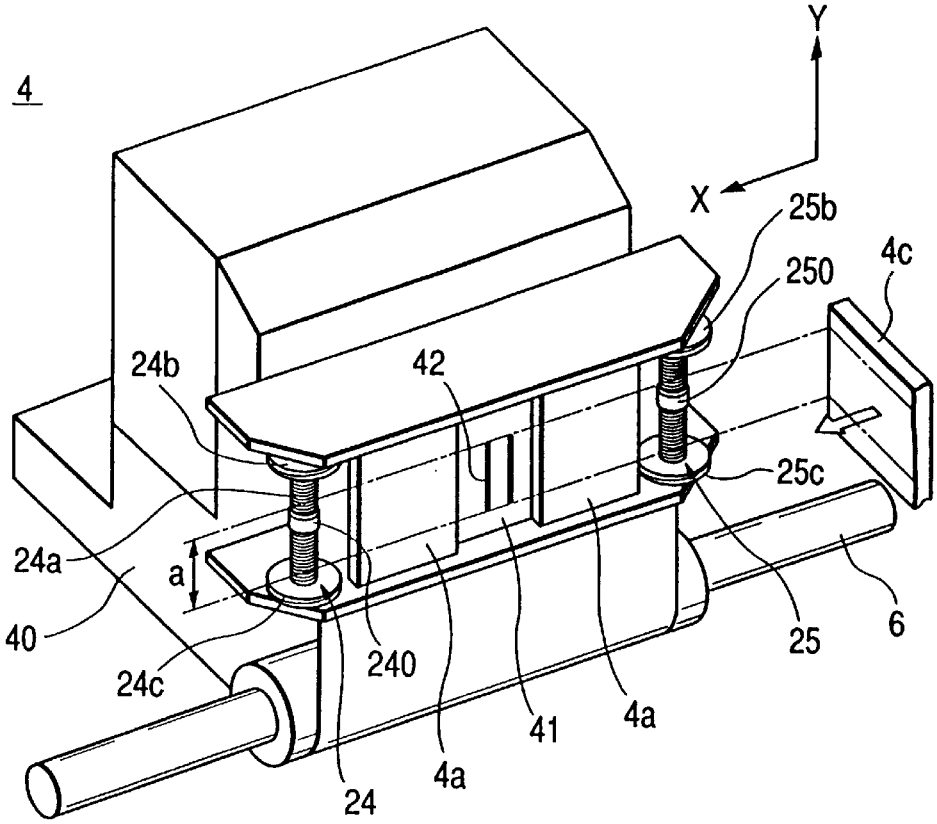
FIG. 6A is a perspective view showing a printing unit of the printer of the fourth embodiment.
Figure 6B:
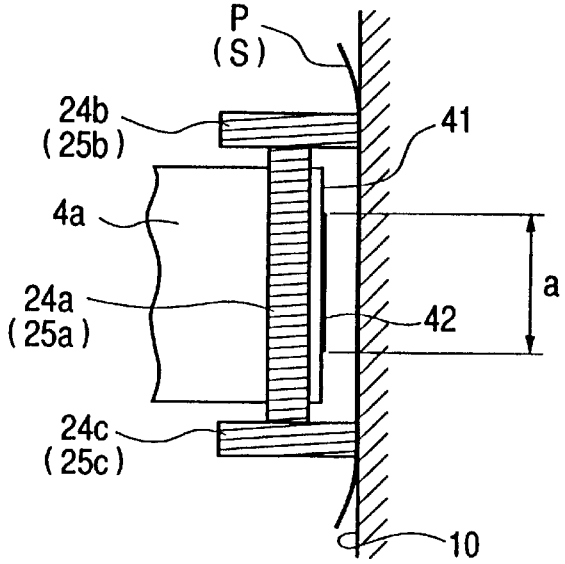
FIG. 6B is a diagram showing a positional relationship between a nozzle face of a print head and a sheet-pressing member in the printer.

FIG. 6A is a perspective view showing a printing unit of the printer of the fourth embodiment. FIG. 6B is a diagram showing a positional relationship between a nozzle face of a print head and a sheet-pressing member in the printer.

As shown in FIG. 6A, a printing unit 4 of the printer includes a carriage 40 which is movable along the guide shaft 6 in a direction X or in the opposite direction to the direction X. A printhead 4*a* is provided on the front side of the carriage 40. A nozzle face 41 occupies a central portion of the printhead 4*a*. Nozzle orifice array 42 are formed in this portion. To print, the nozzle orifice array 42 eject ink drops at given timings in accordance with print information, and prints characters, for example, on a slip sheet S.

A couple of sheet-pressing members 24 and 25 are respectively located upstream and downstream of the printhead 4*a* when viewed in the traveling direction X of the printhead 4*a*. The sheet-pressing members 24 and 25 are constructed with springs which are equal in construction. The sheet-pressing member 24 (25) includes a bar-like shaft portion 24*a* (25*a*), disc-like pressing portions 24*b* and 24*c* (25*b* and 25*c*) provided at both ends of the shaft portion 24*a* (25*a*) as in the embodiments already described, and a fixing portion 240 (250). The sheet-pressing member 24 (25) is fixedly attached, at its fixing portion 240 (250), to the carriage 40.

The outside diameter of each of the pressing portions 24*b* and 24*c* (25*b* and 25*c*) of the sheet-pressing member 24 (25) is larger than the shaft portion 24*a* (25*a*). As shown in FIG.

6B, the pressing portions 24*b* and 24*c* (25*b* and 25*c*) of the sheet-pressing member 24 (25) protrude beyond the nozzle face 41 of the printhead 4*a* so as to come in contact with the platen 10.

The pressing portions 24*b* and 24*c* (25*b* and 25*c*) of the sheet-pressing member 24 (25) are respectively located at positions equally distanced from the nozzle orifice array 42.

The sheet-pressing members 24 and 25 may also be manufactured by a manufacturing method using an automatic coiling machine, as in the embodiments mentioned above.

As shown in FIG. 6A, the wiper 4*c* is provided while being oriented at a right angle to the guide shaft 6. In operation, the printing unit 4 is moved along the guide shaft 6 in the opposite direction to the direction X, while at the same time the wiper 4*c* is moved relatively to the printing unit 4 in the direction X, and wipes ink left on the nozzle orifice array 42 of the printhead 4*a*.

In the present embodiment, the sheet-pressing members 24 and 25 are oriented in a direction Y perpendicular to the guide shaft 6.

As shown in FIGS. 6A and 6B, the pairs of the pressing portions 24*b*, 24*c* and 25*b*, 25*c* of the sheet-pressing members 24 and 25 are located on both sides of a region a including the nozzle orifice array 42 when viewed in the wiping direction (direction X) of the wiper 4*c*, viz., at positions out of the region a.

In this case, the shaft portions 24*a* and 25*a* of the sheet-pressing members 24 and 25 are preferably selected so as to prevent those paired pressing portions 24*b*, 24*c* and 25*b*, 25*c* of the sheet-pressing members 24 and 25 from coming in contact with the wiper 4*c* when the wiper operates for wiping.

In a printing operation, the printer moves the slip sheet S in the direction Y while moving the printing unit 4 in the direction X.

In this case, as shown in FIG. 6B, the slip sheet S is separated from the nozzle-orifice array 42 and pressed on the platen 10 by the pressing portions 24*b*, 24*c* and 25*b*, 25*c*, which are located in the vicinity of the nozzle-orifice array 42. This structural feature prevents the slip sheet S, even if it is bent, from coming in contact with the nozzle face 41. As a result, no ink is transferred to the slip sheet S, and hence a high quality print is secured.

Further, it is noted that the four pressing portions 24*b*, 24*c* and 25*b*, 25*c* are located at the positions equally distanced from the nozzle-orifice array 42. This feature holds the slip sheet S in a well-balancing manner.

Furthermore, it is noted that the pairs of the pressing portions 24*b*, 24*c* and 25*b*, 25*c* are located on both sides of the nozzle-orifice array 42 of the printhead 4*a* when viewed in the traveling direction (direction X) of the printhead 4*a*, and that those pairs of the pressing portions 24*b*, 24*c* and 25*b*, 25*c* are located on both sides of the slip sheet S when viewed in the sheet feeding direction Y. With this structure, those pairs of the pressing portions 24*b*, 24*c* and 25*b*, 25*c* do not come in contact with the printed characters, for example, being still wet on the slip sheet S irrespective of the moving direction of the carriage 40. Therefore, the printer is free from ink sticking problem arising from the rubbing of the printed slip sheet S with the sheet-pressing members 24 and 25.

Also in the embodiment, as shown FIG. 6A, the nozzle face 41 is wiped with the wiper 4*c* in a manner that the carriage 40 is moved in the direction X and hence the wiper 4*c* is moved relatively to the printhead 4*a*.

In connection with this, as recalled, the pairs of the pressing portions 24*b*, 24*c* and 25*b*, 25*c* of the sheet-pressing members 24 and 25 are located at positions out of the region a including the nozzle-orifice array42. Besides, there is no chance that the pairs of the pressing portions 24*b*, 24*c* and 25*b*, 25*c* of the sheet-pressing members 24 and 25 come in contact with the wiper 4*c*, and hence that the wiper 4*c* is worn with those members. No degradation of the wiping ability of the wiper 4*c* results.

Additionally, the present invention uses the sheet-pressing members 24 and 35 formed with spring members. Therefore, in design, a spring constant of them measured in the pressing direction may be set to be small when comparing with the conventional one. This entails reduction of a variation of pressing forces of the sheet-pressing members, which impart onto the slip sheet S, and hence stable application of proper pressing forces to the slip sheet S and stable holding of the slip sheet S.

The integrally formed sheet-pressing members 24 and 25 are fixed to the carriage 40. With this, a large space is not required, and the printer is simple in construction and reduced in size.

Figure 7:
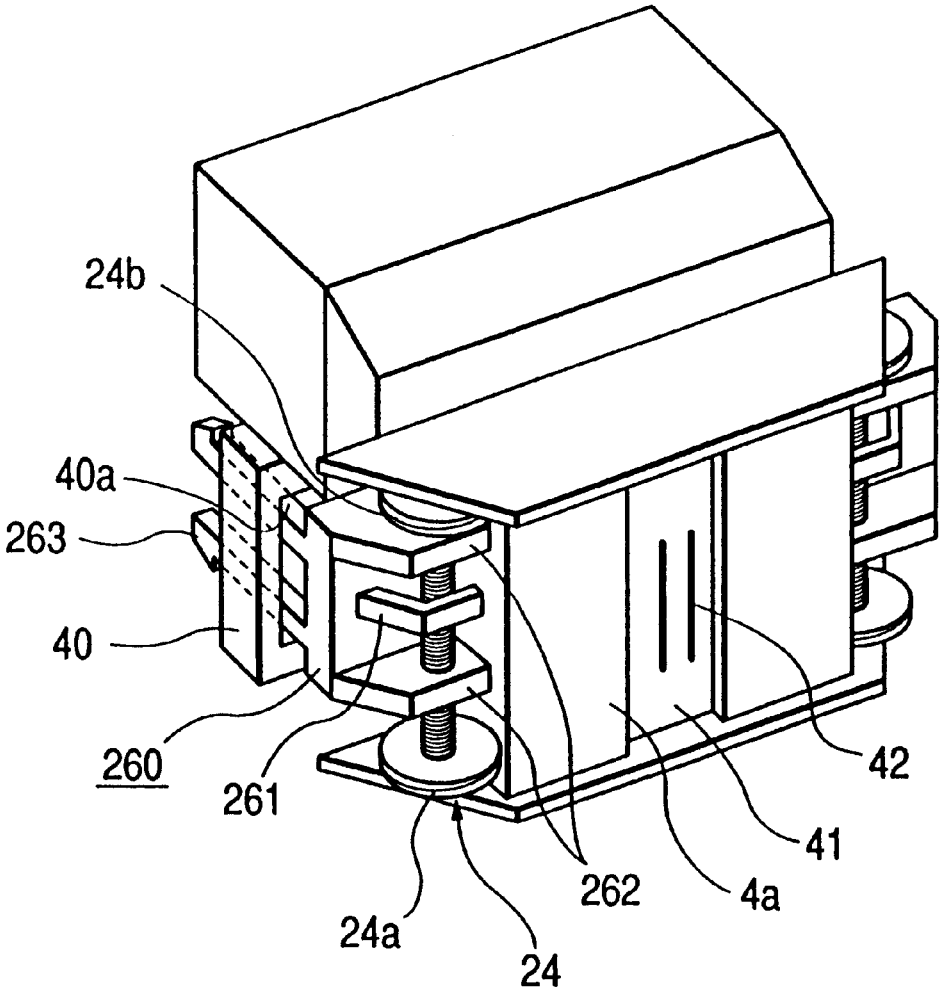
FIG. 7 is a perspective view showing a printing unit in a fifth embodiment of the invention.

A fifth embodiment of the present invention will be described with reference to FIG. 7. FIG. 7 is a perspective view showing a printing unit in the fifth embodiment. In the figure, like or equivalent portions are designated by like reference numerals in FIG. 6.

A mounting member 260 is used for mounting sheet-pressing members 24 and 25 respectively on the upstream and downstream sides of the printhead 4*a* when viewed in the traveling direction X of the printhead 4*a*. The mounting member 260 is made of resin. As shown, two fins 262 and an arm 261 are formed at each end of the mounting member 260 when viewed in the longitudinal direction. The arm 261 is used for holding the central portion of the sheet-pressing member 24 (25).

Each of the fins 262 includes a guide face slanted in the traveling direction of the printhead 4*a*. With provision of the guide faces of the fins 262, the printhead 4*a* may smoothly move to the slip sheet while not catching the end of the slip sheet. if the end of the slip sheet S is raised at a height longer than the radius of each of the pressing portions 24*b* and 24*c*, the end of the slip sheet is guided by the guide faces of the fins 262 and gradually held down on the platen 10 with the movement of the printhead 4*a*.

Claw-like members 263 are provided on the other end of the mounting member 260. Holes 40*a* are formed in the carriage 40 at such locations as to receives the claw-like members 263 of the mounting member 260. The claw-like members 263 and the holes 40a form a called snap-fit construction. With this construction of the mounting member 260, the sheet-pressing members 24 and 25 may easily be mounted on the printhead 4*a*. Further, the guide portions for preventing the printhead 4*a* from catching the end of the slip sheet may be formed at both ends of the printhead 4*a*.

It should be understood to those skilled in the art that the present invention is not limited to the above-mentioned embodiments, but may variously be changed, modified and altered within the true spirits of the invention.

For example, a plurality of pressing portions may be provided at proper positions of the coil spring, which forms the shaft portion of the sheet-pressing member.

While in the above-mentioned embodiments, the sheet-pressing members are held while being angularly immovable with respect to the guide member, it may be held while being angularly movable.

In the fourth and fifth embodiments, the nozzle-orifice array 42 of the printhead is held at four points by use of two sheet-pressing members. So long as such a construction that the pressing portions are provided at both ends of the region a is used, the sheet may be hold by use of two or larger number of pressing portions. To hold down the recording or sheet reliably and in a well-balanced manner, it is preferable to use the medium holding construction employed in the above-mentioned embodiments.

While two pressing members are formed at both ends of the coil spring of the sheet-pressing member in the fourth and fifth embodiments, three or larger number of pressing portions may be formed on one spring coil.

Additionally, it is evident that the sheet-pressing member constructed according to the invention may be applied to any mechanism requiring a stable pressure contact, in addition to the ink jet printer.

The invention is most operant in particular when it is applied to a mechanism for transporting a sheet having printed characters, for example, being not yet fixed or still wet, as in the ink jet printer.

As seen from the foregoing description, the sheet feeding mechanism of the invention is able to impart an optimum pressing force onto a sheet being fed, and hence provides a printer of high quality printing.

What is claimed is:

1. A sheet feeding mechanism for feeding a sheet along a transport path, comprising:

a sheet feed roller; and a sheet-pressing member, disposed so as to press said sheet feed roller, said sheet-pressing member formed by an elastic wire, having a helix section with a generally constant diameter about a central axis, and at least one spiral section generally in a plane perpendicular to said axis and having an outer diameter greater than said constant diameter.

2. A sheet feeding mechanism according to claim 1, wherein said at least one spiral section is located at a middle portion of said helix section.

3. A sheet feeding mechanism according to claim 1, wherein said at least one spiral section is located at a first end of said helix section and an additional spiral section, generally in a plane perpendicular to said axis and having a diameter greater than said constant diameter, is located at a second of said helix section.

4. A printer for printing on a sheet set therein, said printer comprising:

a printhead;

a sheet feed roller, disposed downward of said printhead when viewed in a sheet feeding direction, for feeding a sheet printed by said printhead in a predetermined direction; and a sheet-pressing member, disposed so as to press down said sheet feed roller, said sheet-pressing member formed by an elastic wire, having a helix section with a generally constant diameter about a central axis, and at least one spiral section generally in a plane perpendicular to said axis and having an outer diameter greater than said constant diameter.

5. A printer according to claim 4, wherein said at least one spiral section is located at a middle portion of said helix section.

6. A printer according to claim 5, wherein said printhead is of an ink jet type.

7. A printer according to claim 4, wherein said at least one spiral section is located at a first end of said helix section and an additional spiral section, generally in a plane perpendicular to said axis and having a diameter greater than said constant diameter, is located at a second of said helix section.

8. A printer according to claim 7, wherein said printhead is of an ink jet type.

9. A printer according to claim 4, wherein said printhead is of an ink jet type.

10. A printer comprising:

a printhead for printing characters on a sheet moving relatively to the printhead by ejecting ink drops through ink discharging orifices; and sheet pressing members, located near said discharging orifices, for pressing on the sheet at their positions not in contact with the ink of the characters immediately after printed, said positions being spaced apart from said ink discharging orifices, said sheet-pressing members formed by an elastic wire, having a helix section with a generally constant diameter about a central axis, and at least one spiral section generally in a plane perpendicular to said axis and having an outer diameter greater than said constant diameter.

11. A printer according to claim 10, wherein said sheet pressing members include at least one additional spiral section generally in a plane perpendicular to said axis and having an outer diameter greater than said constant diameter for pressing down both sides of a region on the sheet immediately after characters are printed on the sheet.

12. A printer according to claim 11, further comprising: a wiper for wiping ink stuck onto said discharging orifices while moving relatively to said ink discharging orifices, wherein said sheet-pressing members include at least one additional spiral section generally in a plane perpendicular to said axis and having an outer diameter greater than said constant diameter for pressing down said sheet while being located at positions out of a region including said ink discharging orifices when viewed in the wiping direction of said wiper.

13. A printer according to claim 10 and having a region including said ink dispensing orifices, further comprising: a wiper for wiping ink stuck onto said discharging orifices while moving relatively to said ink discharging orifices, wherein said sheet-pressing members include at least one additional spiral section generally in a plane perpendicular to said axis and having an outer diameter greater than said constant diameter for pressing down said sheet while being located at positions outside of said region including said ink discharging orifices when viewed in the wiping direction of said wiper.

14. A printer for printing on a sheet set therein, said printer comprising:

a printhead;

a guide member disposed downstream of said printhead when viewed in a sheet feeding direction and in a side where said printhead is located with respect to said sheet, said guide member defining a part of a paper transporting passage; and a spring for guiding said sheet in a direction in which said sheet is apart from said guide member, said spring formed by an elastic wire, having a helix section with a generally constant diameter about a central axis, and at least one spiral section generally in a plane perpendicular to said axis and having an outer diameter greater than said constant diameter.

15. A printer comprising:

a printhead for printing characters on a sheet moving relatively to the printhead by ejecting ink drops through ink discharging orifices; and a spring, located near said discharging orifices, for guiding said sheet in a direction in which said sheet is apart from said printhead, said spring being formed by an elastic wire, having a helix section with a generally constant diameter about a central axis, and at least one spiral section generally in a plane perpendicular to said axis and having an outer diameter greater than said constant diameter.

16. A printer according to claim 15, wherein said spring includes at least one additional spiral section generally in a plane perpendicular to said axis and having an outer diameter greater than said constant diameter.

17. A printer comprising:

a printhead;

a guide member disposed downstream of said printhead when viewed in a sheet feeding direction along a paper transporting passage, said guide member defining a part of said paper transporting passage; and a spring at least partially protruded into said paper transporting passage, said spring having a helix section with a generally constant diameter about a central axis, and at least one spiral section generally in a plane perpendicular to said axis and having an outer diameter greater than said constant diameter.

18. A printer according to claim 17, wherein said printhead ejects ink drops onto a sheet surface to be confronted with said guide member.

19. A paper guide for a sheet feeding mechanism, said paper guide comprising:

a guide plate having a surface along which a sheet is to be transported; and a spring supported by said guide plate, said spring having a helix section with a generally constant diameter about a central axis, and at least one spiral section generally in a plane perpendicular to said axis and having an outer diameter greater than said constant diameter, said spiral section being partially protruded from said surface of said guide plate to be contactable with said sheet.

* * * * *